United States Patent [19]

Greene, Sr.

[11] Patent Number: 4,677,723

[45] Date of Patent: Jul. 7, 1987

[54] VALVE BRIDGE CONSTRUCTION METHOD

[75] Inventor: Hilliard F. Greene, Sr., Chicago, Ill.

[73] Assignee: Precision Screw Machine Company, Hillside, Ill.

[21] Appl. No.: 598,250

[22] Filed: Apr. 9, 1984

Related U.S. Application Data

[60] Division of Ser. No. 331,298, Dec. 16, 1981, abandoned, which is a continuation-in-part of Ser. No. 25,382, Mar. 30, 1979, abandoned, which is a continuation of Ser. No. 870,421, Jan. 18, 1978, abandoned, which is a continuation of Ser. No. 721,803, Sep. 8, 1976, abandoned.

[51] Int. Cl.[4] ..... B21D 53/00

[52] U.S. Cl. ..... 29/157.1 R; 29/156.7 B; 29/402.06; 29/402.08; 74/559; 123/90.22; 123/90.46

[58] Field of Search ..... 29/156.7 R, 156.7 B, 29/157.1 R, 402.01, 402.03, 402.04, 402.05, 402.06, 402.07, 402.08; 74/559; 123/90.22, 90.46

[56] References Cited

U.S. PATENT DOCUMENTS

| | | | |
|---|---|---|---|
| 2,380,051 | 7/1945 | Kettering . | |
| 2,700,208 | 1/1955 | Messimer | 29/402.06 |
| 3,140,698 | 7/1964 | Voorhies | 123/90.46 |
| 3,996,653 | 12/1976 | Faris et al. | 29/402.05 |

FOREIGN PATENT DOCUMENTS

| | | |
|---|---|---|
| 563711 | 9/1958 | Canada . |
| 647538 | 8/1962 | Canada . |
| 128680 | 7/1919 | United Kingdom . |
| 236119 | 6/1969 | U.S.S.R. . |

OTHER PUBLICATIONS

Dyke, A. L., *Dyke's Automobile & Gasoline Engine Encyclopedia;* Goodheart-Wilcox Co., Inc. Chicago, Illinois, 22nd ed., 1950; pp. 796–799, 813.

Dodge Passenger Car Service Manual, 1968; No. WM-4778; Service Publications Dept., Windsor, Ontario, Canada.

1964 Chevelle Shop Manual; Chevrolet Motor Division, General Motors Corporation, Detroit, Michigan.

*Primary Examiner*—Howard N. Goldberg
*Assistant Examiner*—Ronald S. Wallace
*Attorney, Agent, or Firm*—Allegretti, Newitt, Witcoff & McAndrews, Ltd.

[57] ABSTRACT

An improved valve bridge assembly and improved method of manufacturing the same, both new and rebuilt, are disclosed. The valve bridge is of the type that actuates the exhaust valves in larger internal combustion engines, such as locomotive diesel engines, and that has oversized lash adjuster sockets due to wear. The method contemplates providing a set of oversized lash adjusters which are chosen for insertion in the oversized sockets. Also, threaded lash adjusters are disclosed.

11 Claims, 8 Drawing Figures

Fig 1
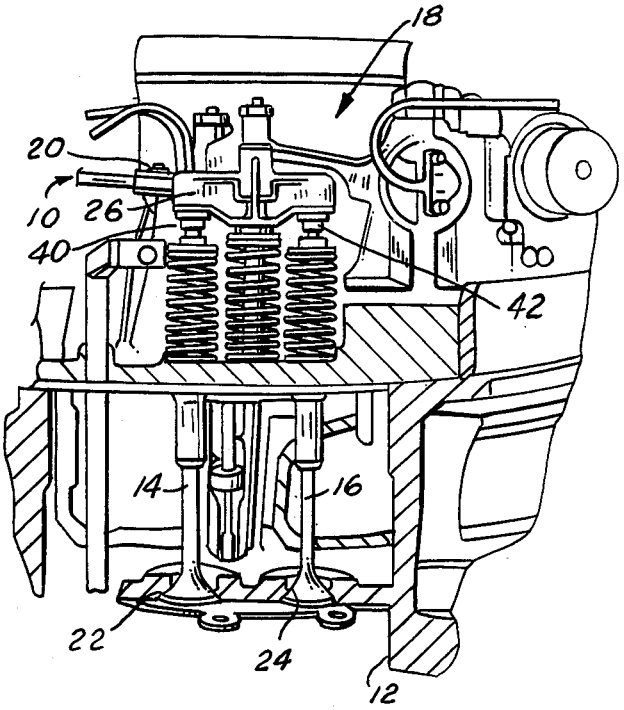
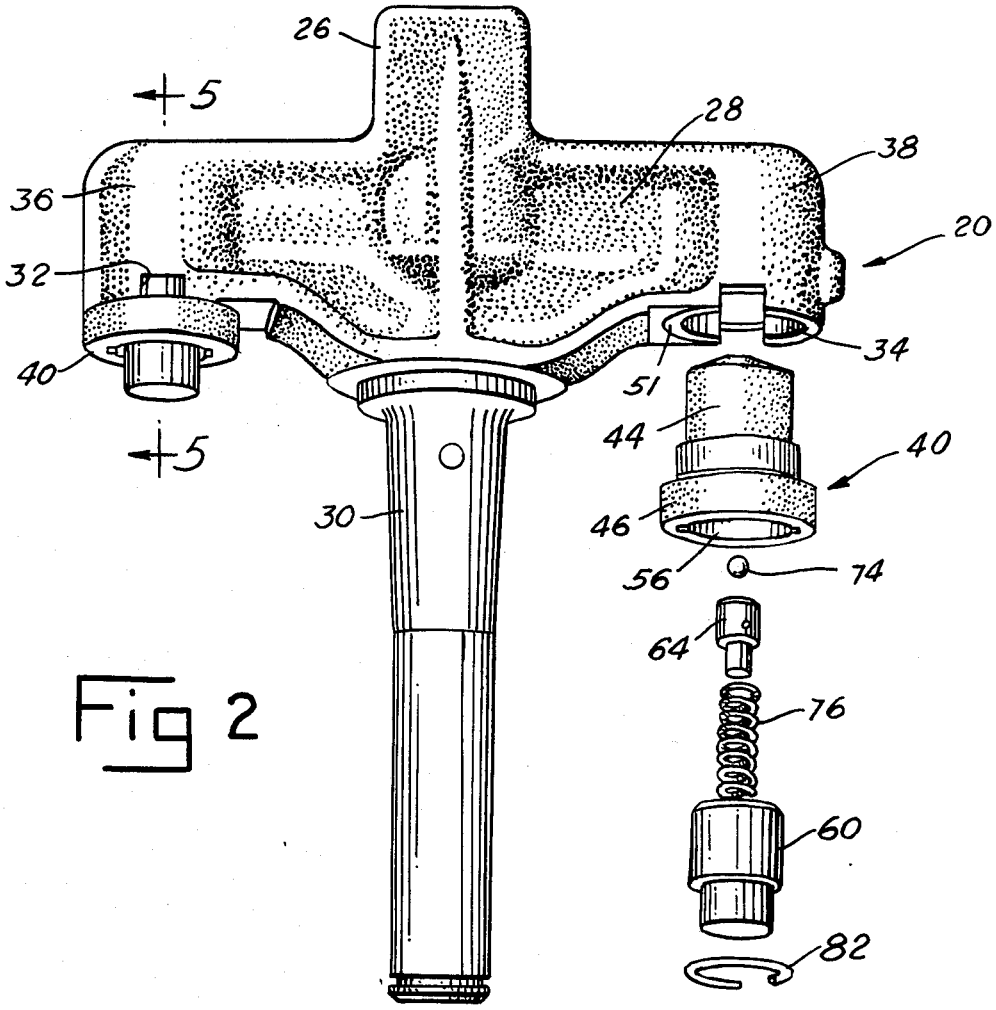
Fig 2

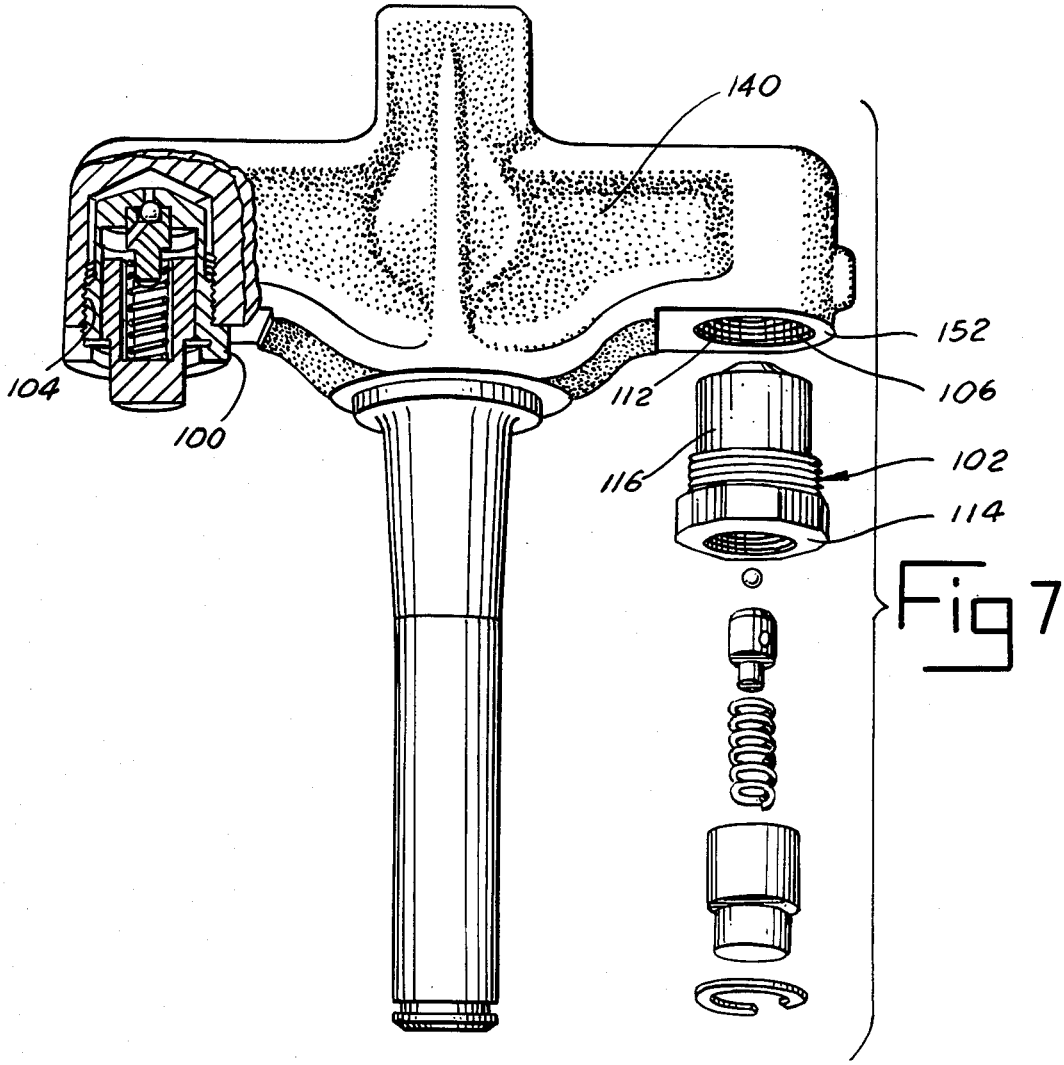
Fig 7
Fig 8
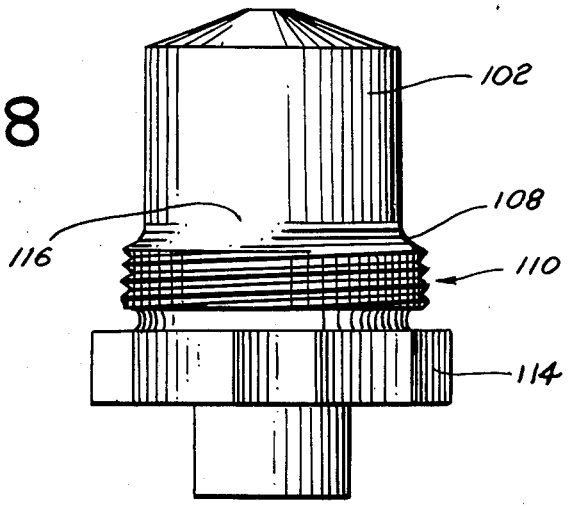

VALVE BRIDGE CONSTRUCTION METHOD

CROSS REFERENCE TO RELATED APPLICATIONS

This is a divisional application of Ser. No. 331,298, filed Dec. 16, 1981, now abandoned, which is a continuation-in-part application of Ser. No. 025,382, filed Mar. 30, 1979, now abandoned, which was a continuation application of Ser. No. 870,421, filed Jan. 18, 1978, now abandoned, which was a continuation application of Ser. No. 721,803, filed Sept. 8, 1976, now abandoned.

BACKGROUND AND SUMMARY OF THE INVENTION

The present invention relates to an improved valve bridge assembly and methods of manufacturing or rebuilding such assemblies.

In larger, internal combuston engines, for example, diesel engines used in locomotives, a valve bridge is part of the mechanism utilized to actuate the two exhaust valves that are associated with an engine cylinder. Typically, each valve bridge includes a main body portion and a cross-arm portion having outer, distal ends cooperative with the valve stems of the two associated exhaust valves. The rocker arm assembly of the engine periodically causes the valve bridge, and thus the exhaust valves, to be moved in a direction parallel to the longitudinal axes of the exhaust valves so as to open the valves.

Lash adjusters have long been used with valve bridges to improve the operation of the exhaust valves and, thus, the overall operation of the engine. Toward this end, a lash adjuster socket is formed in each of the outer, distal ends of the cross-arm portion of a valve bridge, and a lash adjuster is press-fit within each of these sockets. The lash adjusters are positioned so that they are in direct contact with the upper ends of the valve stems. The use of lash adjusters minimizes clearance problems in the exhaust valve actuating mechanism and compensates for thermal expansion and wear in this mechanism. The lash adjusters also serve to automatically adjust the exhaust valve actuating mechanism for smooth, efficient operation and to reduce maintenance of the associated parts of that mechanism.

It has long been an accepted practice in the industry to rebuild the valve bridges in an engine as part of a regular engine maintenance program. The rebuilding of a valve bridge generally includes the replacement of the lash adjusters (originally press-fit into the valve bridge) with either new or "remanufactured," press-fit type lash adjusters. However, after such a conventional valve bridge has been rebuilt two or three times, it has frequently been found that one or both of the lash adjuster sockets have become so oversized, out-of-round, etc., due to wear that standard size, new or re-manufactured, press-fit type lash adjusters can no longer be press-fit within the sockets. Insofar as the industry has been concerned, valve bridges that have such worn lash adjuster sockets are no longer considered as being usable, and it has been the general practice in the industry to discard or scrap such worn valve bridges.

There are approximately eighteen million valve bridges in use at the present time. One major company in the industry discarded over two hundred thousand worn valve bridges in the last several years and another company has over one hundred and fifty thousand worn valve bridges now awaiting scrapping. Since the cost of a new valve bridge is presently over forty-five dollars, the industry practice of discarding or scrapping worn valve bridges is one of considerable economic significance.

Accordingly, the industry has for years been attempting to solve the problem of how to avoid discarding or scrapping these worn valve bridges when, in effect, most of these worn valve bridges would still have a long, useful life, if it were not for the fact that their lash adjuster sockets had become worn and oversized. In this regard, some worn valve bridges are repaired by "filling" the worn lash adjuster socket with a weldment and then reaming or grinding out the socket to its original, inner diameter dimension. Although this method of rebuilding worn valve bridges generally produces satisfactory results, it is a time consuming procedure and thus is relatively expensive.

Another proposed solution to this longstanding problem contemplates that the outer distal ends of the cross-arm portion of the valve bridges be swadged through the use of a press in order to reduce the inner diameter dimension of a worn lash adjuster socket, thereby enabling a standard size, press-fit type lash adjuster to be press-fit within the socket again. The difficulty with this proposal is that there is a tendency for the cross-arm portions of the worn valve bridges to crack as a result of this swadging action. In addition, it is difficult to ascertain the amount of swadging that can be accomplished without cracking the cross-arm portion of the valve bridge.

Still others in the industry have proposed to solve this longstanding problem by dipping worn valve bridges in chrome plating solutions in order to plate the valve bridges, including the inside of their lash adjuster sockets. The sockets are then reground to their original inner dimension so that standard size, press-fit type lash adjusters can be press-fitted therein. This proposal, however, has not been widely adopted by the industry because particles of the plating frequently "flake off" and get into the hydraulic oil used with the lash adjusters thereby tending to cause the lash adjusters to "freeze."

It has also been suggested as a solution that the inside surfaces of a worn lash adjuster socket be knurled so that the socket can again accept a standard size new or remanufactured lash adjuster. Knurling has also not found acceptance in the industry because of the expense involved and because it does not really provide a satisfactory rebuilt valve bridge.

In summary then, the industry has, for many years, followed the practice of discarding or scrapping used valve bridges which were structurally sound except for the fact that one or both of their lash adjuster sockets had become oversized, out-of-round, etc. This practice has prevailed even though the industry has long recognized that this practice presents a serious economic problem with respect to minimizing the cost of maintaining and repairing internal combustion engines.

Although a variety of solutions to this longstanding problem has been proposed, none of the proposed solutions has received widespread acceptance in the industry. Consequently, large numbers of worn valve bridges utilizing press-fitted adjusters are still being discarded or scrapped each year, even though, as above-noted, these valve bridges would be perfectly capable of continued usage in engines were it not for the fact that one or both of their lash adjuster sockets had become worn oversized to such a degree that the bridges are unusable.

My improved valve bridge assembly and methods of manufacturing the same, both new and rebuilt, provide a novel, inexpensive, and practical solution to this problem which has faced the industry for many, many years. More specifically, my improved valve bridge includes a cross-arm with distal ends and lash adjuster sockets adjacent to each of the distal ends. The lash adjuster sockets, when new, have standard sized openings which receive standard sized lash adjusters, each of which have a body with a flange, an upper cylindrical portion, and a radially projecting rib member adjacent to and above the flange. The rib member extends around the circumference of the upper cylindrical portion and has an outer diameter dimension greater than the mean diameter dimension of the standard sized opening in the socket when new.

My improved method of manufacturing my improved valve bridge assembly disclosed herein has two alternative embodiments. The first is used to rebuild a worn valve bridge having unthreaded lash adjusters and includes the steps of removing the used, old valve adjusters from the valve bridge, cleaning the bridge, measuring or in some other manner ascertaining the dimensions of the worn lash adjuster sockets in the valve bridge, selecting a specially made new or remanufactured unthreaded lash adjuster whose outer body dimensions are comparable to the inner diameter dimension of the worn lash adjuster sockets, and then press-fitting the selected oversized lash adjuster into the worn lash adjuster socket of the valve bridge.

The performance of my improved method can be expeditiously accomplished by having available groups of oversized unthreaded lash adjusters, with the adjusters in each of the groups being oversized by a specific, predetermined amount. For example, one group would be oversized by fifteen thousandths of an inch, the second by thirty thousandths of an inch and the third by forty-five thousandths of an inch over the standard diameter of a lash adjuster. Thus, for example, a person rebuilding worn valve bridges need only measure an inner diameter dimension of a worn lash adjuster socket and then readily select an oversized lash adjuster from the group of lash adjusters having an oversized dimension comparable to the measured inner diameter dimension of the worn socket.

To enable a person using my improved method to quickly select the compatible oversized lash adjuster, color coding can be applied to the oversized lash adjusters. The color coding will indicate the amount that a particular lash adjuster is oversized with respect to the dimension of the standard size lash adjuster.

My improved method described above works well to solve the problem of rebuilding worn valve bridges that have been manufactured to accept press-fitted lash adjusters. For valve bridges not already manufactured, however, an alternative embodiment of my improved method greatly increases the useful life of the original lash adjusters and greatly reduces the otherwise frequent need for rebuilding either the lash adjuster sockets or the lash adjusters themselves. This alternative embodiment method can also be used to remanufacture or rebuild worn valve bridges that were originally manufactured to accept press-fitted lash adjusters. This latter method includes the steps of threading an outer portion of the cylindrical body on the lash adjusters, threading an inner portion of the lash adjusters sockets so that the threaded portions of the lash adjusters can be screwed into, and mate with, the threaded portions on the sockets, and then screwing the lash adjusters into place with the sockets on the valve bridge.

The threaded lash adjuster-and-socket combination produced by this latter alternative method will continue to hold the lash adjusters in place in the sockets long after an unthreaded adjuster would have slid out of a worn, unthreaded adjuster socket. For example, I have found that a valve bridge originally manufactured with the threaded lash adjuster-and-socket combination has a useful life that is four to five times the useful life of the old, standard press-fit type of lash adjuster-and-socket combination. Even though the threaded socket of my improved valve bridge will eventually wear out with use, the threads in the socket and on the adjuster will continue to mate even as they become worn down—until they have worn down so far that they no longer mate sufficiently well to hold the adjuster within the socket.

For over twenty years, the industry has been well aware of the problem for which my apparatus provides a ready and practical solution. Yet prior to my invention, no one had a satisfactory solution to this problem, much less developed a product or method similar to my product and corresponding methods as described and claimed herein. In this regard, literally millions of used valve bridges have been discarded or scrapped over the years by those in the industry, even though, but for the fact that their lash adjuster sockets had become oversized, their used valve bridges were structurally sound and capable of many more years of satisfactory performance in internal combustion engines. An incentive for those in the industry to develop a solution to this longstanding problem has always existed since a new valve bridge costs over fourty-five dollars; whereas, a new lash adjuster costs under three dollars and a remanufactured lash adjuster costs even less. Furthermore, even though my invention has been available to the industry for only a few months, it has already been accepted and recognized by persons in the industry as being a practical answer to this longstanding problem and one that is significantly superior to the methods which have heretofore been proposed to overcome this problem.

It is therefore an object of my invention disclosed herein to provide an improved valve bridge and method of rebuilding a valve bridge wherein one or both of the lash adjuster sockets therein have become oversized, out-of-round, etc., due to wear.

It is another primary object of my present invention to provide a valve bridge assembly with a lash adjuster that compensates for wear of the lash adjuster socket and will thereby remain in position in a worn lash adjuster socket.

It is also an object of my present invention to provide an improved valve bridge assembly that has a rib member surrounding the circumference of the upper portion of the body of a lash adjuster and having an outer diameter dimension greater than the mean diameter dimension of the lash adjuster socket when new. The lash adjuster will thereby remain in position even as the lash adjuster socket becomes worn somewhat oversize through use.

A still further object of my present invention is to provide an improved valve bridge and method of rebuilding it wherein the improved method includes the steps of removing the old, used, unthreaded lash adjusters from the lash adjuster sockets in the valve bridge, cleaning the valve bridge, measuring an inner diameter dimension of each of the worn lash adjuster sockets, selecting new or remanufactured oversized, unthreaded lash adjusters having out diameter dimensions comparable to the inner diameter dimensions of the oversized lash adjuster sockets, and then reassembling the valve bridge by press fitting the oversized lash adjusters into the measured lash adjuster sockets.

An even further object of my present invention is to provide an improved valve bridge and method of rebuilding it wherein each oversized lash adjuster includes an indicia on its body indicating the size of its outer diameter dimension so as to facilitate the selection of the oversized lash adjuster having outer diameter dimensions comparable to the inner diameter dimensions of an oversized lash adjuster socket.

An additional object of the present invention is to provide an improved valve bridge and method of manufacturing or remanufacturing it wherein each lash adjuster and lash adjuster socket is at least partially threaded and the lash adjusters are screwed into place in the sockets. The lash adjusters will thereby remain in position within the sockets long after conventional, press-fit lash adjusters would have worn out of position in the sockets.

A yet additional object of my present invention is to provide an improved valve bridge and method of manufacturing wherein each lash adjuster has a flange with means for gripping or clamping the adjuster or screwing the adjuster into place in a lash adjuster socket.

These and other objects and advantages of my present invention will become apparent from the following description of the preferred embodiment of this invention, described in connection with the accompanying drawings.

DESCRIPTION OF THE DRAWINGS

FIG. 1 is a partial perspective view of a portion of an internal combustion engine showing a part of the mechanism utilized to actuate the two exhaust valves associated with one of the cylinders in the engine.

FIG. 2 is a side plan view of one embodiment of my improved valve bridge wherein one unthreaded lash adjuster is shown press-fit within one of the unthreaded lash adjuster sockets of the valve bridge and wherein a second unthreaded lash adjuster, with its component parts shown in an exploded position, is disposed adjacent to the other unthreaded lash adjuster socket of the valve bridge.

FIG. 7 is a side plan view of an alternative embodiment of my improved valve bridge wherein one threaded lash adjuster is shown in exploded form adjacent to an unthreaded lash adjuster socket of the valve bridge and a portion of the cross-arm on the bridge is broken out to show the cross-sectional view of the other lash adjuster when threaded in the lash adjuster socket.

FIG. 8 is a side plan view of a threaded lash adjuster made for use in connection with the improved method of my present invention.

Figure 3:
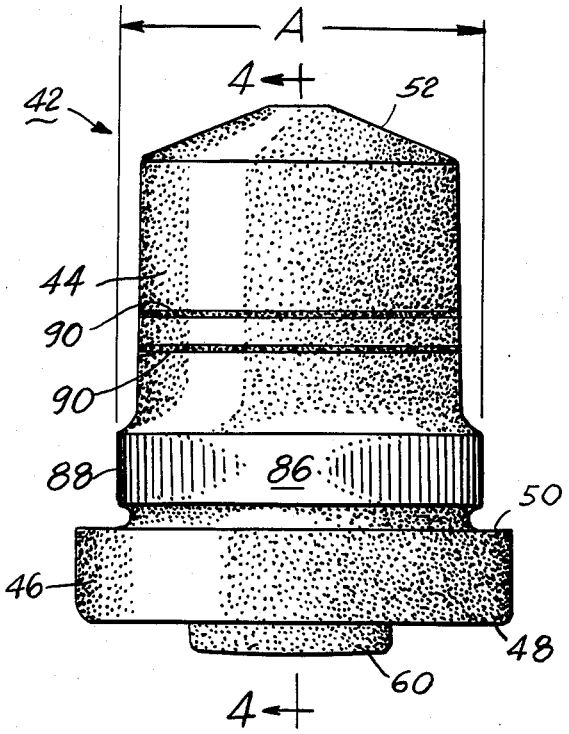
FIG. 3 is a side plan view of an oversized, unthreaded lash adjuster made for use in connection with the improved method of my present invention.

Throughout the various figures of the drawings, the same reference numerals will be used to designate the same parts or components. Moreover, when the terms "right", "left", "upper", "lower", "up", and "down" are used herein, it is to be understood that these terms have reference to the structure shown in the drawings as it would appear to a person viewing the drawing.

DESCRIPTION OF THE PREFERRED EMBODIMENT

Referring now to FIG. 1 of the drawings, a portion of a conventional internal combustion engine is indicated generally at 10. The engine 10 may, for example, be a large diesel engine of the type utilized in locomotives and includes a cylinder 12 which has two exhaust valves 14 and 16 associated therewith. The mechanism utilized to actuate the exhaust valves 14 and 16 includes a cam shaft, not shown, a rocker arm assembly, shown generally at 18, and a valve bridge assembly, shown generally at 20. Except as hereinafter noted, the valves 14 and 16, the cam shaft, the rocker arm assembly 18, and the valve bridge assembly 20 are of conventional design and construction, and they all function in a conventional manner.

During the operation of the engine 10, rotation of the cam shaft causes the rocker arm assembly 18 to depress the valve bridge 20 so as to, in turn, cause the exhaust valves 14 and 16 to be moved away from their seats 22 and 24 in the cylinder 12. Proper action of the exhaust valves 14 and 16 is a critical factor in efficient engine operation since, during normal engine operation, the exhaust valves 14 and 16 are opened and closed in the range of 800–900 times per minute, depending upon the R.P.M. of the engine 10.

As best shown in FIG. 2 for a conventional valve bridge with unthreaded lash adjusters press-fitted into unthreaded sockets on the bridge, the valve bridge assembly 20 includes a valve bridge 26 comprising a transverse cross-arm portion 28 and a longitudinal main body portion 30. Lash adjuster sockets 32 and 34 are formed in the outer, distal ends 36 and 38, respectively, of the cross-arm portion 28. The sockets 32 and 34 open downwardly toward the exhaust valves 14 and 16, respectively, and the central longitudinal axes of the sockets 32 and 34 are parallel with the central longitudinal axis of main body portion 30 of the valve bridge 26.

To facilitate the action of the exhaust valves 14 and 16, conventional, unthreaded lash adjusters 40 and 42 (42 shown in exploded view in FIG. 2) are press-fit in the sockets, 32 and 34 respectively, in the distal ends 36 and 38 of the cross-arm portion 28 of the valve bridge 26 and are disposed between the distal ends 36 and 38 and, as shown in FIG. 1, the upper ends of the valve stems of the exhaust valves 14 and 16. The use of the lash adjusters 40 and 42 minimizes any clearance in the valve actuating mechanism and compensates for thermal expansion and wear in this mechanism. In addition, the lash adjusters 40 and 42 automatically adjust the exhaust valve actuating mechanism in order to provide smooth, efficient operation of the exhaust valves 14 and 16 and reduce the maintenance of the associated parts of the mechanism.

The valve bridge 26 shown in FIG. 2 has been used for a substantial period of time, and as a result, the inner diameter dimension of the unthreaded sockets 32 and 34 have become enlarged due to wear. However, when the valve seat 22 (shown in FIG. 1) was initially manufactured, the inner dimensions of the sockets 32 and 34 were machined so that standard sized, unthreaded lash adjusters 40 and 42 could be press-fit therein so that the lash adjusters would remain properly positioned within the sockets during normal operation of the engine 10 (shown in FIG. 1). In this regard, the standard outer diameter dimension of conventional, unthreaded lash adjusters has for years been 0.8755 inches.

Though the unthreaded lash adjusters 40 and 42 are structurally and functionally identical except as explained hereinbelow, the outer diameter dimension of these adjusters 40 and 42 may be different in practice since, in accordance with the principles of my invention, the outer dimension of these unthreaded lash adjusters are selected so as to be comparable with the inner diameter dimensions of the worn, oversized, unthreaded sockets 32 and 34 in which they are press-fit. In view of the structural identity of the unthreaded lash adjusters 40 and 42, only the adjuster 42, as shown in FIGS. 2–4, is described in detail.

With reference to FIG. 2, the unthreaded lash adjuster 42 includes a generally cylindrical outer body 44 having a radially outwardly extending flange 46 formed at its lower end 48. The outer diameter of the flange 46, as shown in FIG. 2, is greater than the inner diameter dimension of the socket 34 so that, as shown in FIG. 3, the inner radial surface 50 of the flange 46 abuts against, as shown in FIG. 2, the annular portion 51 of the cross-arm portion 28 immediately surrounding the socket.

Figure 4:
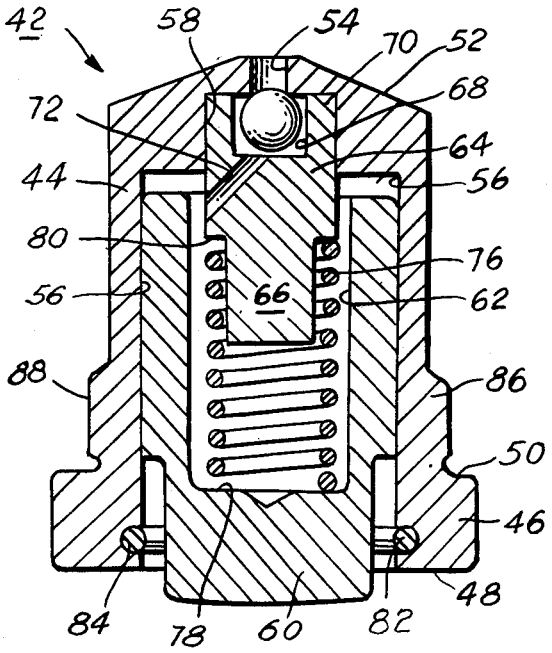
FIG. 4 is a vertical cross-sectional view taken along the line 4—4 in FIG. 3.

Referring now to FIG. 4, the upper end 52 of the body 44 has a generally frusto-conical shape and has a relatively small diameter oil inlet passage 54 disposed therein such that the central longitudinal axis of the passage 54 is coaxial with the central longitudinal axis of the body 44 of the lash adjuster 42. The passage 54 is adapted to be connected with a source of oil or hydraulic fluid, not shown.

Still referring to FIG. 4, the body 44 has a bore 56 and a smaller diameter counterbore 58 formed therein. The bore 56 communicates with the exterior of the body 44, adjacent to the lower end 48 and with the counterbore 58, which in turn communicates with the passage 54. The bore 56 and counterbore 58 are formed in the body 44 such that their central longitudinal axes are coaxial with each other and with the central longitudinal axis of the body 44.

A cylindrical plunger 60 is disposed in the bore 56 so that relative sliding movement may occur between the plunger 60 and the body 44. The plunger 60 includes a cylindrical recess 62, which faces the upper end 52 of the body 44 when the plunger 60 is positioned within the body 44, whose central longitudinal axis is coaxial with the central longitudinal axis of the body 44.

A cylindrical, stepped diameter retainer 64 is press-fit within the counterbore 58 and extends from the counterbore 58 toward the lower end 48 of the body 44 so that its smaller diameter, lower projecting end 66 is disposed within the recess 62 of the plunger 60. A relatively small, cylindrical recess 68 is formed in the upper, larger diameter end 70 of the retainer 64 and is in direct fluid communication with the passage 54. A passage 72 is formed in the upper end 70 of the retainer 64 and extends between the recess 68 and the interior of the bore 56. The central longitudinal axes of the retainer 64, its ends 66 and 70, and the recess 68 therein are coaxial with the central longitudinal axes of the body 44 while the longitudinal axis of the passage 72 is disposed at an acute angle with respect to the central longitudinal axis of the body 44.

A ball 74 is positioned within the recess 68 of the retainer 64. The diameter of the ball 74 is larger than the diameter of the passage 54 so that when the ball 74 is adjacent to the passage 54, the ball blocks flow through the passage 54. The diameter of the ball 74, however, is less than the diameter of the recess 68.

A coil compression spring 76 is disposed within the recess 62 of the plunger 60 and extends between the lower end 78 of the plunger 60 and the shoulder 80 formed on the retainer 64 between the lower and upper ends 66 and 70 thereof. The spring 76 urges the plunger 60 downwardly in the bore 56 and away from the retainer 64. A snap ring 82 is positioned within a groove 84 formed in the bore 56 adjacent to the upper end 48 of the body 44 and serves to retain the plunger 60 within the bore 56.

During operation of the engine 10 (shown in FIG. 1), oil or other hydraulic fluid is present within the passage 54, the recess 68, the passage 72, the recess 62, and that portion of the bore 56 between the upper end 52 of the body 44 and the lower end 78 of the plunger 60. As shown in FIG. 1, as the cam shaft of the engine 10 rotates, the rocker arm assembly 18 forces the valve bridge assembly 20 to move downwardly toward the exhaust valves 14 and 16. During this downward movement, the plunger 60, as shown in FIG. 4, tends to move inwardly against the force of the spring 76. The oil trapped in the body 44 forces the ball 74 to close the oil inlet passage 54.

As shown in FIG. 1, the continued downward movement of the valve bridge assembly 20 causes the exhaust valves 14 and 16 to move away from their seats 22 and 24. Referring back to FIG. 4, some of the oil trapped in the body 44 leaks down through the clearance between the plunger 60 and the bore 56 during this relative movement between the plunger 60 and the bore 56. Again referring to FIG. 1, continued cam shaft rotation allows the valve bridge assembly 20 to move upwardly. When the valves 14 and 16 are again seated on their seats, 22 and 24 respectively, the pressure on the lash adjuster plunger 60, as shown in FIG. 4, is relieved. The lash adjuster spring 76 then moves the plunger 60 upwardly relative to the bore 56, and this permits the ball 74 to move away from the passage 54 so that oil is again permitted to enter the recess 68 through the passage 54 and, from there, flow through the passage 72 into the interior of the lash adjuster body 44 so as to replenish any oil leakage that occured during, as shown in FIG. 1, the downward stroke of the valve bridge assembly 20. This cycle of operation is repeated each time the cam shaft actuates the rocker arm assembly 18.

Figure 6:
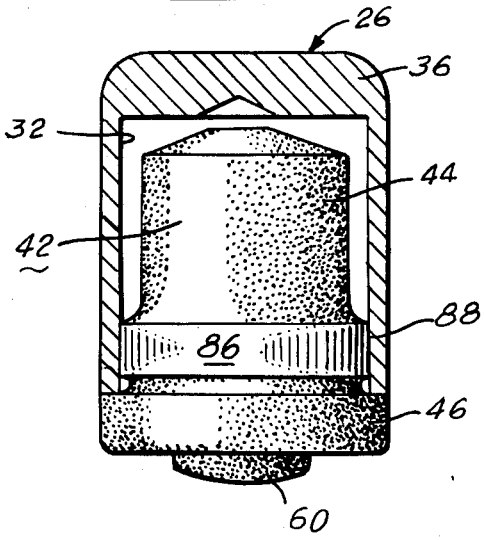
FIG. 6 is a cross-sectional view similar to that shown in FIG. 5 and illustrates the fit between an oversized, unthreaded lash adjuster socket and an oversized, unthreaded lash adjuster selected so that its outer diameter dimension is comparable to the inner diameter dimension of the oversized, unthreaded lash adjuster socket.

As shown in FIG. 3, the outer cylindrical wall of the body 44 or the unthreaded lash adjuster 42 has a raised rib 86 formed thereon adjacent to the flange 46. The outer diameter dimension, indicated by the letter "A" in FIG. 3, of the rib 86 is less than the outer diameter of the flange 46 and is machined to be comparable in diameter to, as shown in FIG. 6, the inner diameter dimension of the socket 34, in which the lash adjuster is to be press-fit. More specifically, the rib 86 includes an annular radially outwardly facing surface 88 whose central longitudinal axis is coaxial with the longitudinal axis of the body 44 and which is adapted to be in surface-to-surface contact with the inner surface of the socket 34. The diameter dimension "A" of this surface 88 is selected so that when the lash adjuster 42 is positioned within a lash adjuster socket 34, a press-fit will exist between the lash adjuster and the lash adjuster socket such as shown in FIG. 6.

With reference again to FIG. 1, when it is desired to rebuild a conventional valve bridge, such as the valve bridge 26, in accordance with my present invention, the bridge 26 is removed from the engine 10. Initially, the used, unthreaded lash adjusters are removed from the lash adjuster sockets 32 and 34 in the bridge, as shown in FIG. 2. The bridge, including the unthreaded sockets 32 and 34, is then cleaned, and the inner diameter dimensions of the unthreaded sockets 32 and 34 are measured by any conventional means. Oversized, unthreaded lash adjusters 40 and 42 are then selected with reference to their diameter dimensions "A" as shown in FIG. 3 so that their dimensions "A" match the measured inner diameter dimensions of, as shown in FIG. 2, the oversized, threaded sockets 32 and 34. Thereafter, the selected unthreaded adjusters 40 and 42 are press-fit within the sockets, 32 and 34, respectively, and as shown in FIG. 1, the rebuilt valve bridge 26 is again ready for use in the engine 10.

Figure 5:
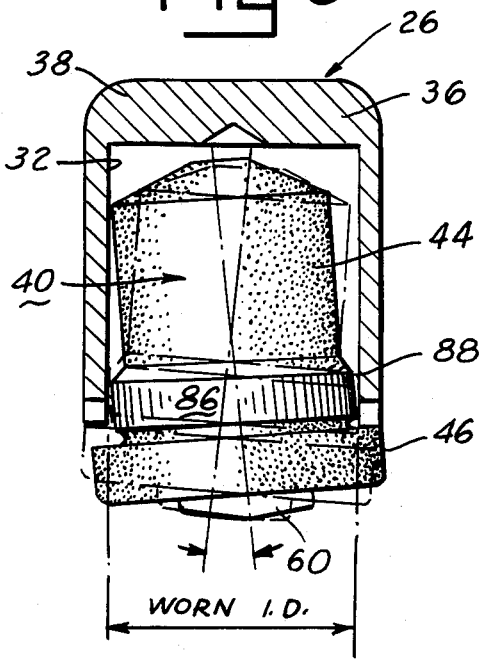
FIG. 5 is a partial vertical cross-sectional view taken along the line 5—5 in FIG. 2 and illustrates the difficulties which may occur when a standard size, unthreaded lash adjuster is disposed within an oversized, unthreaded lash adjuster socket.

FIG. 5 illustrates the relationship which would occur between an unthreaded lash adjuster and an unthreaded lash adjuster socket if a person attempted to use a standard size, unthreaded lash adjuster 40 in an oversized, worn, unthreaded lash adjuster socket such as the socket 34. However, when a properly selected, oversized, threaded lash adjuster, such as adjuster 42, is press-fit within an enlarged, unthreaded lash adjuster socket 34 in accordance with the principles of my invention as illustrated in FIG. 6, the relationship between the adjuster 42 and socket 34 is similar to the relationship which exists between a standard size, unthreaded lash adjuster and a standard sized, unthreaded socket in a conventional, newly manufactured valve bridge. Furthermore, a valve bridge assembly which has been rebuilt pursuant to my improved method will function in the same manner as a conventional, new valve bridge assembly; whereas, if a person attempts to use a standard size, unthreaded lash adjuster 40 with an oversized, unthreaded worn socket 22, such as shown in FIG. 5, the valve bridge assembly will not function properly.

In accordance with the basic principle underlying my invention and referring now to FIG. 3, the diameter dimension "A" of the surface 88 of the unthreaded lash adjuster 42 is machined so that it has an outer diameter dimension greater than the standard 0.8755 inch dimension. To facilitate the selection of the proper oversize, unthreaded lash adjuster to be used with a particular oversized, worn, unthreaded lash adjuster socket, groups of unthreaded lash adjusters can be machined to different oversize dimensions. For example, a first group of oversized, unthreaded lash adjusters can be made having a diameter dimension "A" of 0.8700 (+0.000, −0.0005); a second group of oversized lash adjusters can be made having a dimension "A" of 0.8710 (+0.000, −0.0005); while still a third group can be made having a diameter dimension "A" of 0.8720 (+0.000, −0.0005). In this regard, and to enable a workman to distinguish between the first, second, and third groups, the first group might be coded with indicia consisting of a single colored band or strip being applied around the outer surface of its body 44 between the rib 86 and the upper end 52. Similarly, the oversize, unthreaded lash adjusters in the second group could be coded by having two bands or stripes of the same or differing colors being applied around the body 44 while the oversize, unthreaded lash adjusters in the third group could be coded by having three bands or stripes of the same or differing colors applied to the body 44. In this regard, the unthreaded lash adjuster 42 has two such bands or stripes, as indicated at 90, applied to its body 44.

An alternative embodiment of my present invention is shown in FIGS. 7 and 8. In that embodiment as shown in FIG. 7, the lash adjusters 100 and 102 and the lash adjuster sockets 104 and 106 are threaded so that the lash adjusters 100 and 102 can be screwed into place within their respective lash adjuster sockets 104 and 106 on the valve bridge 140.

The lash adjusters 100 and 102 have substantially identical dimensions as do the lash adjuster sockets 104 and 106. As shown in FIG. 8 for one of the threaded lash adjusters 102, the rib member 108 on the lash adjuster 102 has four complete threads, generally 110, rolled in the rib member 108. The body type of the threads 110 is 15/16-16 UNR. As shown in FIG. 7 for one of the threaded lash adjuster sockets 106, the reciprocal threading, generally 112, in the socket 106 is of the body type 15/16-16 UNF-2B. The socket 106 is threaded to a depth of 7/16" from the annular portion 152.

Referring to FIGS. 7 and 8, the flange 114 on the threaded lash adjuster 102 is machined, i.e., shaped, to provide four planar surfaces along its radial periphery. The surfaces are spaced about equally apart from one another along the periphery of the flange 114 and are thereby arranged in diametrically opposing pairs. Each of the surfaces is also substantially parallel to the axis of the upper cylindrical body 116 of the threaded lash adjuster 102.

I have found that other embodiments of my present invention as shown in FIGS. 7 and 8 will also work suitably well to achieve the objects for the threaded lash adjuster as stated above. Toward the end of achieving those objects, however, I have found that the design criteria set forth in the table below will yield the best results for all such suitable embodiments:

| | $R_1$ = ATB/AB | T | $R_2$ = RPC/ACC |
|---|---|---|---|
| Maximum | 1:1 | 2.5 | 2:1 |
| Minimum | 1:5 | 5 | 1:1 |

In the above table, the symbols used have the following meanings:

ATP—Axial length of the threaded portion 110 on the rib member 108.

AB—Axial length of the cylindrical body portion 44 of the lash adjuster 102.

T—Total number of threads on the threaded portion 110 on the rib member 108.

RPC—Radial distance (as measured from the axis of the lash adjuster 102) between a peak and either crest on each thread.

ACC—Axial length from crest to crest on each thread.

The design criteria for the threaded portion 112 in the socket 106, as shown in FIG. 7, should be such that the threaded portion 110 of the lash adjuster 102 will fully mate with the socket's threaded portion 112 when the lash adjuster 102 is screwed into the socket 106.

The method of the alternative embodiment shown in FIGS. 7 and 8 can be used to either manufacture completely new valve bridges or rebuild or remanufacture worn ones. In order to use this latter method to remanufacture worn valve bridges having standard, press-fit lash adjusters, the old lash adjusters, such as 40 shown in FIG. 5, must be removed from their sockets 32, and then the sockets 32 should be cleaned and inspected to insure that the internal diameters of the sockets 32 are not damaged or out-of-round to the point that they cannot accommodate threading. The sockets 32 are then threaded as described above for manufacturing a new valve bridge, such as 140 shown in FIG. 7 having threaded lash adjusters 100 and 102 and lash adjuster sockets 104 and 106. Then, reciprocally threaded lash adjusters, such as 102 shown in FIG. 7, are screwed into the threaded sockets, such as 106.

In conclusion, my improved valve bridge assembly and method of manufacturing or remanufacturing it provide a practical solution to a problem that the industry has faced for many, many years. As noted above, after a valve bridge has been used for an extended period, e.g., for two to three years, the inner diameter dimension of the lash adjuster sockets in the standard valve bridge generally become worn to such an extent that standard lash adjusters can no longer be press-fit within the worn socket. Over the years, there have been a number of proposals concerning resizing of the inner diameter dimension of the worn lash adjuster sockets. As a practical matter, none of these proposed solutions have received wide-spread acceptance in the industry, primarily because of costs involved. Hence, prior to my invention, it was still the general industry practice to discard or scrap used valve bridges once their lash adjuster sockets had worn oversize and to replace these worn valve bridges with new valve bridges. This practice has continued even though a new valve bridge presently costs over forty-five dollars and even though, except for their oversized sockets, the worn valve bridges were structurally sound and capable of further usage. With over millions of valve bridges in use in the industry, the cost to the industry of discarding or scrapping these used valve bridges was and still is overwhelmingly significant.

One of the principle advantages of the improved method of my present invention is that it materially extends the productive life of such used valve bridges without appreciably increasing the cost of manufacturing or rebuilding the valve bridges. In other words, new valve bridges can be manufactured with threaded lash adjusters and sockets for very little extra cost, and their lash adjusters will remain in proper position within lash adjuster sockets for a much longer amount of time (sometimes three to four times more) than is the case for press-fit type lash adjusters. In addition, used valve bridges, originally having press-fit type lash adjusters, can be rebuilt to incorporate threaded lash adjusters which will extend the life of the used valve bridges well beyond what their lives would have been using the rebuilding techniques in the prior art. Alternatively, used press-fit type valve bridges having worn oversized lash adjuster sockets can be rebuilt using my alternative rebuilding method, using oversized lash adjusters, for substantially the same cost as rebuilding valve bridges that do not have oversized lash adjuster sockets, and a person employing my invention thus realizes a significant saving equal to the cost of a new valve bridge.

Since my invention, as disclosed herein, may be embodied in other specific forms without departing from its spirit or central characteristics, the preferred embodiment described herein is therefore to be considered in all respects as illustrative and not restrictive. The scope of my invention is indicated by the following claims rather than by the foregoing description, and all changes which come within the meaning and range of equivalency of the claims are therefore intended to be embraced therein.

What is claimed is:

1. An improved method of rebuilding a used valve bridge assembly of the type that actuates the exhaust valves in a cylinder of a diesel locomotive engine, said bridge including a cross-arm with distal ends and lash adjuster sockets adjacent to each of the distal ends, each of the lash adjuster sockets having an opening adapted to receive a lash adjuster by being press-fit therein in order to provide smooth, efficient operation of the exhaust valves, and said bridge having at least one lash adjuster socket with an inner diameter worn oversized so that a standard size lash adjuster can no longer be properly fitted therein, the improved method of:

maintaining a stock of oversized lash adjusters which each include an outer cylindrical wall having a radially outwardly projecting rib member adapted to be in surface-to-surface contact with the inner surface of the lash adjuster sockets and having an outer diameter dimension larger in diameter than the outer diameter dimension of the corresponding rib on the standard size lash adjuster;

disassembling the used valve bridge, including removing the used lash adjusters from each of the lash adjuster sockets;

cleaning the valve bridge, including the lash adjuster sockets formed therein, without machining the lash adjuster sockets in the valve bridge;

measuring the inner diameter dimension of each of the oversized lash adjuster sockets in the valve bridge;

selecting an oversized lash adjuster from said stock of oversized lash adjusters having an outer diameter dimension comparable to the measured inner diameter dimension of each of the oversized lash adjuster sockets; and reassembling the valve bridge, including press-fitting the selected oversized lash adjuster into the measured lash adjuster socket so that the radially outwardly projecting rib member is in surface to surface contact with the inner surface of the measured lash adjuster socket.

2. The improved method described in claim 1 wherein the selected oversized lash adjuster is a new lash adjuster.

3. The improved method of claim 1 wherein the selected oversized lash adjuster has indicia on its outer body for indicating the size of its outer dimension, thereby facilitating the selection of an oversized lash adjuster having outer diameter dimensions compatable with the inner diameter dimensions of the oversized lash adjuster socket.

4. The improved method described in claim 1 wherein the indicia includes at least one colored band marked on the outer tubular side wall of the body of the oversized lash adjuster.

5. The improved method described in claim 3 wherein the selected oversized lash adjuster is a new lash adjuster.

6. An improved method of manufacturing or remanufacturing a valve bridge assembly of the type that actuates the exhaust valves in a cylinder of a diesel locomotive engine, said bridge including a cross-arm with distal ends and lash adjuster sockets adjacent to each of the distal ends, each of the lash adjuster sockets having an opening adapted to receive a lash adjuster in order to provide smooth, efficient operation of the exhaust valves, each of said lash adjusters having a flange, an upper body portion, and a rib member adjacent said flange and said upper body portion, the improved method of:

threading at least a portion of the rib member of each lash adjuster;

threading an inner portion of each lash adjuster socket so that the threaded rib member of the lash adjuster can be screwed into, and mate with, the threaded inner portion of the lash adjuster socket;

machining the flange of each lash adjuster to provide means for grasping the adjuster in order to screw the adjuster into the lash adjuster opening in the lash adjuster socket; and screwing each lash adjuster firmly into place within a lash adjuster socket on the valve bridge.

7. The improved method of claim 6 including the step of threading the rib member with at least two and one-half but no more than five threads, and further including the step of forming threads having a peak and a crest on each side of said peak, the ratio of the radial distance between the peak and a crest on each thread and the distance from crest to crest on each side of said peak being between 1:1 and 2:1.

8. An improved method of manufacturing or remanufacturing a valve bridge assembly of the type that actuates the exhaust valves in a cylinder of a diesel locomotive engine, said bridge including a cross-arm with distal ends and lash adjuster sockets adjacent to each of the distal ends, each of the lash adjuster sockets having an opening adapted to receive a lash adjuster in order to provide smooth, efficient operation of the exhaust valves, each of said lash adjusters having a flange, an upper body portion, and a rib member adjacent said flange and said upper body portion, the improved method of:

threading at least a portion of the rib member of each lash adjuster;

threading an inner portion of each lash adjuster socket so that the threaded rib member of the lash adjuster can be screwed into, and mate with, the threaded inner portion of the lash adjuster socket;

machining the flange of each lash adjuster to provide means for screwing the adjuster into the lash adjuster opening in the lash adjuster socket; and screwing each lash adjuster firmly into place within a lash adjuster socket on the valve bridge.

9. The improved method of claim 8 including the step of threading the rib member with at least two and one-half but no more than five threads, and further including the step of forming threads having a peak and a crest on each side of said peak, the ratio of the radial distance between the peak and a crest on each thread and the distance from crest to crest on each side of said peak being between 1:1 and 2:1.

10. An improved method of manufacturing or remanufacturing a valve bridge assembly of the type that actuates the exhaust valves in a cylinder of a diesel locomotive engine, said bridge including a cross-arm with distal ends and lash adjuster sockets adjacent to each of the distal ends, each of the lash adjuster sockets having an opening adapted to receive a lash adjuster in order to provide smooth, efficient operation of the exhaust valves, each of said lash adjusters having a flange, an upper body portion, and a rib member adjacent said flange and said upper body portion, the improved method of:

threading at least a portion of the rib member of each lash adjuster;

threading an inner portion of each lash adjuster socket so that the threaded rib member of the lash adjuster can be screwed into, and mate with, the threaded inner portion of the lash adjuster socket;

machining the flange of the lash adjuster to provide at least two substantially parallel planar surfaces along the radial periphery of said flange, said planar surfaces being diametrically opposite each other and substantially parallel to the axis of the upper body portion of the adjuster, whereby the planar surfaces of the flange facilitate screwing of the lash adjuster into the lash adjuster opening in the lash adjuster socket; and screwing each lash adjuster firmly into place within a lash adjuster socket on the valve bridge.

11. The improved method of claim 10 including the step of threading the rib member with at least two and one-half but no more than five threads, and further including the step of forming threads having a peak and a crest on each side of said peak, the ratio of the radial distance between the peak and a crest on each thread and the distance from crest to crest on each side of said peak being between 1:1 and 2:1.

* * * * *